US008465384B2

(12) United States Patent
Blosser et al.

(10) Patent No.: US 8,465,384 B2
(45) Date of Patent: Jun. 18, 2013

(54) FLETCHING SLEEVE SYSTEM AND METHOD OF APPLICATION AND MANUFACTURE

(76) Inventors: Ben D. Blosser, Richland, IN (US); Sean E. Gordon, Tucson, AZ (US)

( * ) Notice: Subject to any disclaimer, the term of this patent is extended or adjusted under 35 U.S.C. 154(b) by 0 days.

(21) Appl. No.: 13/615,119

(22) Filed: Sep. 13, 2012

(65) Prior Publication Data

US 2013/0072332 A1 Mar. 21, 2013

Related U.S. Application Data

(60) Provisional application No. 61/535,286, filed on Sep. 15, 2011.

(51) Int. Cl.
*F42B 6/06* (2006.01)

(52) U.S. Cl.
USPC ..... 473/586

(58) Field of Classification Search
USPC ..... 16/421, 431, 436; 473/578, 585, 473/586
See application file for complete search history.

(56) References Cited

U.S. PATENT DOCUMENTS 1,235,309 A * 7/1917 Garretson ..... 38/95
1,730,820 A * 10/1929 Holden ..... 16/431
2,887,319 A * 5/1959 Lay ..... 473/586
3,815,916 A * 6/1974 Meszaros ..... 473/586
4,204,307 A 5/1980 Pfetzing
4,660,832 A * 4/1987 Shomo ..... 16/431
5,730,231 A * 3/1998 Racodon ..... 173/162.2
5,819,594 A * 10/1998 Sjovall ..... 74/551.9
5,944,617 A * 8/1999 Falone et al. ..... 473/300
5,951,419 A * 9/1999 Cameneti ..... 473/586
6,641,493 B1 * 11/2003 Shifflett ..... 473/578
6,974,626 B2 * 12/2005 Horacek ..... 428/354
7,485,057 B2 2/2009 Afshari
2011/0015009 A1 1/2011 Kozlik

* cited by examiner

*Primary Examiner* — John Ricci
(74) *Attorney, Agent, or Firm* — Lyman Moulton, Esq.

(57) ABSTRACT

A disclosed fletching sleeve system and method of application and manufacture includes a fletching sleeve configured to frictionally fit onto an arrow shaft. The sleeve defines glue application holes and channels or cavities on an inner surface thereof adjacent the glue holes. Glue disposed on the arrow shaft at the holes is drawn into conduits formed between the channels and/or cavities with the arrow shaft. The sleeve also comprises three vanes formed integrally with the sleeve as one piece. One of the vanes may comprise a recessed surface to receive a decorating or indicia sticker flush with the vane. A collet application tool comprises two semi-cylindrical fingers extending orthogonally from a handle body, the fingers configured to hold and expand the sleeve as it and the collet are slid over the arrow nock and shaft. A dual core pin method of manufacturing enables forming a straighter sleeve and facilitates draft.

20 Claims, 8 Drawing Sheets

FLETCHING SLEEVE SYSTEM AND METHOD OF APPLICATION AND MANUFACTURE

CROSS-REFERENCE TO RELATED APPLICATION

This application claims the benefit of the priority date of earlier filed U.S. Provisional Patent Application Ser. No. 61/535,286, titled 'A Retching System and Method of Application' filed Sep. 15, 2011 for Ben D. Blosser and Sean E. Gordon, incorporated herein by reference in its entirety.

BACKGROUND OF THE INVENTION

Vanes can become easily damaged in the field due to collisions with other arrows, target pass through, target misses, etc. Any of these situations may lead to the vane needing replacement. Replacement usually requires a specialized jig, knowledge and skill to replace damaged vanes properly. Therefore, many archers opt to take a damaged arrow to an archery pro shop to have the vanes replaced.

The one piece vane has been around for many years, it has been used on mainly youth style arrows as it is a lower cost method of producing a vane, usually it is a press or friction type fit onto youth arrows. It is easy to use the press or friction type fit for this application due to the consistency in diameter of a certain manufacture's youth arrow. Nobody has successfully marketed a one piece vane to the adult market as there are more variations in diameter of arrows and not a good way to attach the one piece vane to the varying diameters.

Some manufacturers market a piece of shrink tubing that has three conventional vanes glued to it. It is slid onto the arrow and dipped into boiling water where it shrinks and conforms around the arrow. Tests and field use of shrink tubing has indicated there is much room for improving the durability of the heat shrink vane. Also, there is a long felt need for an inherently less expensive alternative.

SUMMARY OF THE INVENTION

The disclosed archery fletching system includes a fletching sleeve configured to fit around an arrow shaft. The sleeve includes a plurality of raised portions and contact portions on an inner surface of the sleeve, the raised portions configured to form cavities together with the arrow shaft for an application of an adhesive there between and the contact portions configured to directly contact the arrow shaft. An archery fletching sleeve is also configured to fit around a commercially available arrow shaft, the sleeve defining at least one adhesive application portal formed together with the arrow shaft to receive an adhesive during an application thereof onto the arrow shaft. An archery fletching sleeve is yet configured to fit around a commercially available arrow shaft, the sleeve comprising at least one adhesive application portal therein, wherein a ratio of portal area to sleeve surface area is at least one part portal area in 18.4 parts sleeve surface area, the portal(s) configured to receive an adhesive applied to the arrow shaft at the portal(s).

The fletching system and method of application may include a low durometer fletching sleeve configured to frictionally fit onto an arrow shaft. The sleeve defines a plurality of glue application holes and a plurality of channels or cavities on an inner surface of the sleeve adjacent the glue holes. Glue disposed on the sleeve at the holes is drawn into conduits formed between the channels and/or cavities with the arrow shaft and distributed across the inner surface of the sleeve onto the arrow shaft. Capillary action caused by surface tension and intermolecular forces of adhesion between the glue and the sleeve and the arrow shaft, draws the glue from the holes into the resulting conduits. The fletching sleeve also comprises three vanes formed integrally with the sleeve as one piece. One of the vanes may comprise a recessed surface to receive a sticker flush with the vane and thereby avoid aerodynamic interference. The sticker may be used to decorate the vane or to display identifying and advertising indicia.

The disclosed fletching system also includes a collet application tool comprising two semi-cylindrical finger extensions configured to hold and expand the fletching sleeve as it and the collet are slid over the arrow nock and shaft. The collet tool also includes a substantially rigid body configured orthogonally to the two semi-cylindrical fingers and designed to fit into the palm of a user's hand.

Other aspects and advantages of embodiments of the disclosure will become apparent from the following detailed description, taken in conjunction with the accompanying drawings, illustrated by way of example of the principles of the disclosure.

Figure 1:
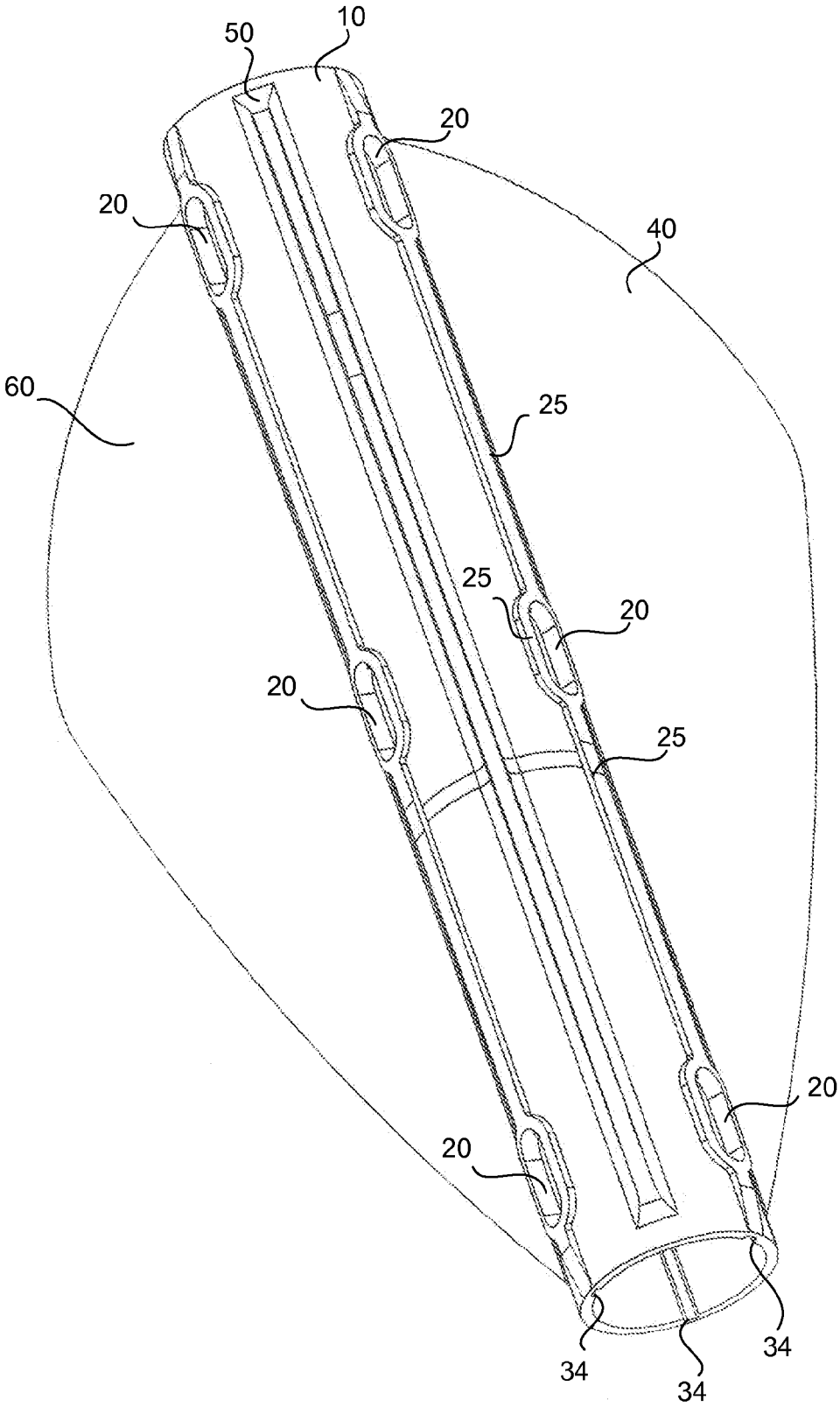
FIG. 1 depicts a perspective view of a straight channel fletching sleeve in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The disclosed fletching system and method of application make replacement or original installation of arrow vanes much easier, faster and economical. The present disclosure enables the serious archer to quickly and inexpensively repair damaged vanes in the field without boiling water to shrink wrap a replacement sleeve or otherwise performing laborious and time consuming procedures.

Throughout the present disclosure and continuances and/or divisional disclosures thereof, the terms 'slot,' 'channel' and 'conduit' may be used interchangeably to define a passageway for a glue from a source to a destination in the passageway formed with an arrow shaft. However, the term 'channel' generally refers to a 360 degree enclosed passaged way resulting from an open slot disposed adjacent an arrow shaft. The term 'cavity' used throughout may define an empty space of various sizes and shapes that comprise open and/or closed hole square, rectangular, circular and elliptical cross-sectional geometries and also slots, channels and conduits. Also, the term 'vane' or 'fletching' used throughout may define a structure which directs or channels airflow over an arrow shaft or between vanes and may not resist or impede an airflow over the arrow nor affect its flight there through unless arranged specifically to do so. The term 'hole' refers to an opening or orifice defined by a 360 degree structure of the fletching sleeve. The term 'portal' is defined by two or more structures together which from an opening or orifice for a passageway in the fletching sleeve such as a portal formed at the end of a channel formed by a slot and the arrow shaft.

FIG. 1 depicts a perspective view of a straight channel fletching sleeve in accordance with an embodiment of the present disclosure. The depiction includes a fletching sleeve 10, glue holes 20, raised sleeve portions 25 also known as raised rib portions, raised portion slots 30 on an underside of the sleeve 10, glue portals 34 formed at the end of a fletching sleeve by a slot or channel therein, a first vane 40, a second vane 50 and a third vane 60. The fletching sleeve 10 may define at least two or three glue application holes 20 disposed between any two vanes and therefore a total of 9 or more glue holes. The fletching sleeve 10 may include three vanes formed integrally with the sleeve as one piece extruded or injection molded. Though the three vanes 40, 50 and 60 are depicted as in-line with a longitudinal axis of the sleeve, alternate embodiments may include vanes formed offset with the longitudinal axis of the sleeve as depicted below in FIG. 2.

The low durometer fletching sleeve 10 is configured to frictionally fit on an arrow shaft (not depicted). The sleeve comprises a low durometer material having some memory of shape and form and some elastic restoring force to its original cross section to accommodate varying arrow shaft diameters. Embodiments of the fletching sleeve may also be made to varying lengths to allow vanes of varying lengths to be formed thereon. The sleeve defines a plurality of glue application holes and a plurality of channels or cavities on an inner surface of the sleeve 10 adjacent the glue holes 20 and concentric with the glue holes in an embodiment of the disclosure. The channels 30 form conduits with the arrow shaft for glue applied at the holes 20 when the fletching sleeve is disposed on the arrow shaft. Glue disposed on the sleeve 10 at the holes 20 is drawn into the resulting conduits and distributed between the holes and across the inner surface of the sleeve and the arrow shaft. Capillary action caused by surface tension and intermolecular forces of adhesion between the glue and the sleeve 10 and the arrow shaft, draws the glue from the holes 20 into the resulting conduits.

The height h or the length of a glue column in a fletching sleeve conduit may be given by:

$$h = \frac{2\gamma\cos\theta}{\rho g r},$$

where γ the liquid-air surface tension (force/unit length), θ is the contact angle, ρ is the density of liquid (mass/volume), g is local gravitational field strength (force/unit mass), and r is the radius of the conduit (length). For water-based glues applied to the fletching sleeve under standard conditions, $\gamma$=0.0728 N/m at 20° C., $\theta$=20° (0.35 rad), $\rho$ is 1000 kg/m$^3$, and g=9.8 m/s$^2$. Cyanoacrylate glues may have a slightly higher density factor of approximately 1.1 times the density of water. Accordingly, the height or length of the glue column between the fletching sleeve and the arrow shaft may be approximated as:

$$h \approx \frac{1.4\times10^{-5}}{r} m.$$

In a 10 one-thousandths of an inch diameter tube (radius 0.0049 in), the glue may travel 1.75 inches through a sleeve-shaft conduit or nearly nine-tenths of an inch through a 5 one-thousandths of an inch sleeve-shaft conduit. The channels 30 are therefore formed approximately 5 to 10 thousandths of an inch in depth and width in the inner surface of the fletching sleeve 10 and extend from a first end of the sleeve to a second end of the sleeve and have a length nominally (1.75 inches) 44.5 mm including one of a ten percent plus and a ten percent minus manufacturing tolerance.

An embodiment of the disclosure may include a constant outside diameter of the sleeve 10 and a portion of the sleeve thinner over the cavities in relation to the rest of the sleeve 10. A portion of the sleeve over the cavities may also form a raised rib portion 25 on an outside surface of the sleeve 10 in order to maintain a constant thickness of the sleeve 10 over the cavities. The raised rib portion 25 may extend to a glue hole 20 and form a raised annular or donut circumference around the glue hole 20. Therefore, a raised portion 25 on an outside diameter of the fletching sleeve 10 may include a raised rib portion 25 and an annular portion 25 around each glue hole 20 to which the rib 25 extends. Cavities may form a plurality of slots 30 on an inner surface of the sleeve, the slots configured to interconnect a plurality of glue holes 20 defined in the sleeve, the slots 30 configured to form channels with the arrow shaft and draw a glue applied to the holes 20 through the slots via a capillary action in the channels formed with the arrow shaft. A further embodiment may include the slots 30 configured to be parallel with an elongate axis of the sleeve, the slots 30 configured to form a plurality of stretch sutures between a sleeve portion above each slot and another portion of the sleeve, the stretch sutures configured to lower an overall stretch resistance of the sleeve 10 to facilitate an application of the sleeve onto the arrow shaft. Cavities may also form a plurality of circumferential slots (not depicted) on the inner surface of the sleeve 10, the circumferential slots concentric with a center defined in the sleeve. The cavities may form a plurality of slots on an inner surface of the sleeve wherein the slots comprise a depth of (5 thousandths of an inch) 0.13 mm to (10 thousandths of an inch) 0.25 mm and a width of (one thousandths of an inch) 0.03 mm. In yet another embodiment of the disclosure, cavities may form a plurality of slots on an inner surface of the sleeve wherein the slots comprise one configuration of substantially orthogonal internal vertices and another semi-circular configuration with no vertices and any other slot-like configuration.

Figure 2:
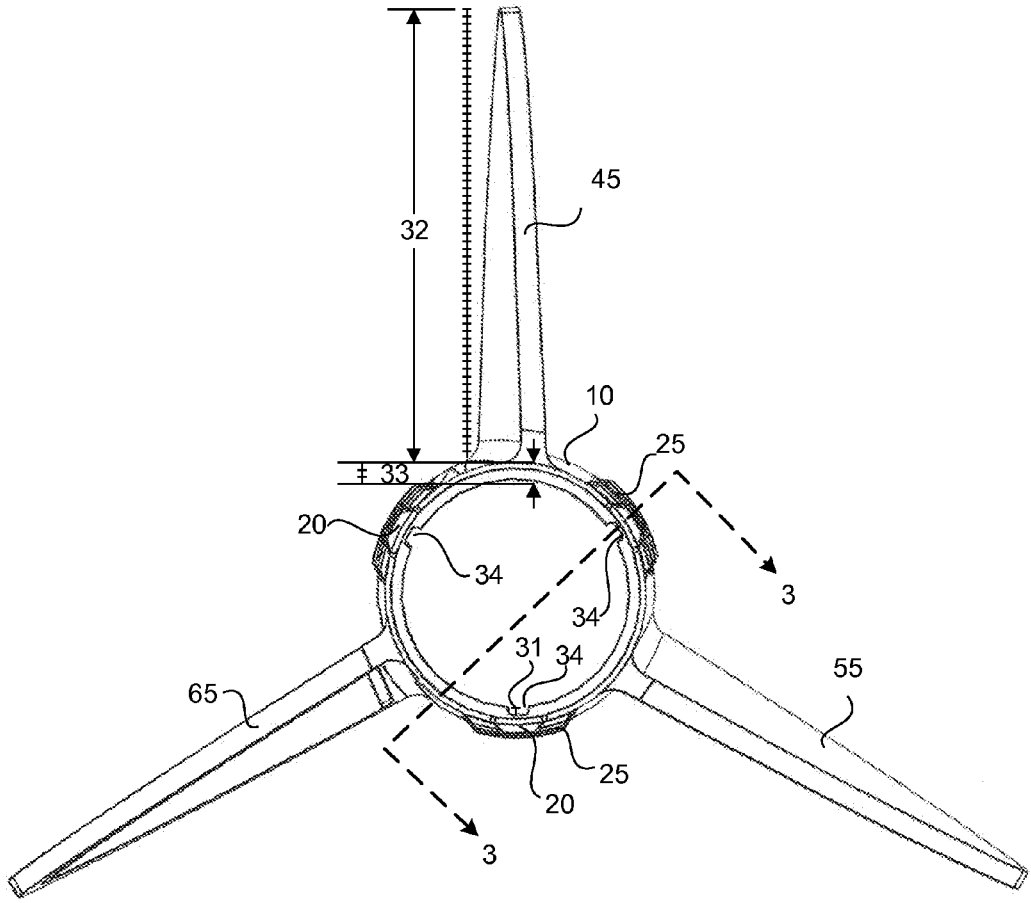
FIG. 2 depicts an end elevational view of a straight channel fletching sleeve in accordance with an embodiment of the present disclosure.
Figure 3:
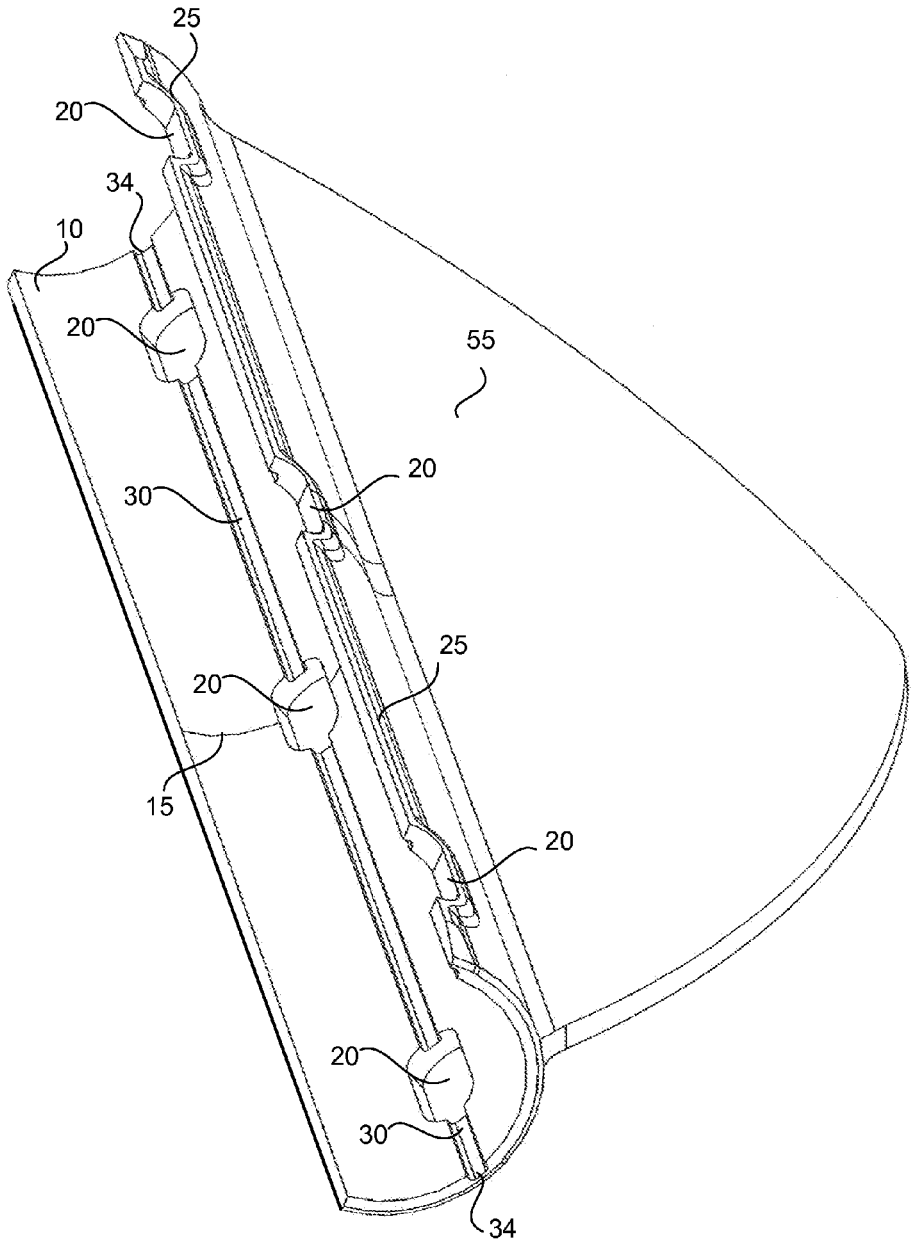
FIG. 3 depicts the cross sectional view 3-3 taken lengthwise through the fletching sleeve of FIG. 2 in accordance with an embodiment of the present disclosure.

FIG. 2 depicts an end elevational view of a straight conduit fletching sleeve in accordance with an embodiment of the present disclosure. The depiction shows the fletching sleeve 10, the glue holes 20, raised portions 25 and the straight channels 30 an glue portals 34 formed at the end of a fletching sleeve by a slot or channel therein. The cross section 3-3 taken lengthwise through the fletching sleeve is depicted in FIG. 3 as described below. The fletching sleeve 10 also comprises three vanes formed integrally with the sleeve as one piece. It may be noticed that the three vanes 45, 55 and 65 are offset from an elongate axis on the sleeve and therefore may impart a slight aerodynamic spin to the arrow when in flight. Embodiments of the present disclosure also include vanes formed in-line with an elongate axis on the sleeve imparting no aerodynamic drag or airflow resistance or spin to the arrow in flight. Dimensions 31, 32 and 33 indicate relative heights of the slot or channel 30 to a respective height of a vane and a respective height or thickness of the fletching sleeve as depicted. Therefore, using the slot or channel height 31 as a relative unit of measure, the vane height is 60 units tall and the sleeve height or sleeve thickness is 3 units tall or thick. Therefore, ratios of the height of the slot or height of the channel from the arrow shaft are respectively determined to be 1 part slot or channel height to 60 parts vane height (taken from the outer circumference of the sleeve to the tallest portion of a vane) and 1 part slot/channel height to 3 parts sleeve height/thickness as depicted.

An embodiment of the disclosure includes at least one adhesive application portal(s) including raised portions 25 configured to protrude above an outside diameter of the sleeve 10 and receive and contain the adhesive for application onto the arrow shaft. An adhesive application portal also known as a glue hole 20 may extend any length, radius and shape in the sleeve and be joined by a plurality of glue slots of any length formed on an inside of the fletching sleeve running longitudinally, radially and any direction from one of a portal to another portal and to a slot dead-end.

FIG. 3 depicts the cross sectional view 3-3 taken lengthwise through the fletching sleeve of FIG. 2 in accordance with an embodiment of the present disclosure. The depiction shows the fletching sleeve 10, the core pin abutment line 15, the glue holes 20, raised portions 25 and the straight channels 30 formed on the inside of the fletching sleeve and adjoining three glue holes each and glue portals 34 formed at the end of a fletching sleeve by a slot or channel therein. The channels 30 as depicted are each formed in a straight line parallel with an elongate axis of the sleeve. The channels may be configured to form a stretch suture between the resulting thinner sleeve above each channel and the thicker portions of the sleeve. The stretch sutures therefore may lower the overall stretch resistance of the sleeve to facilitate application of the sleeve onto the arrow shaft.

Figure 4:
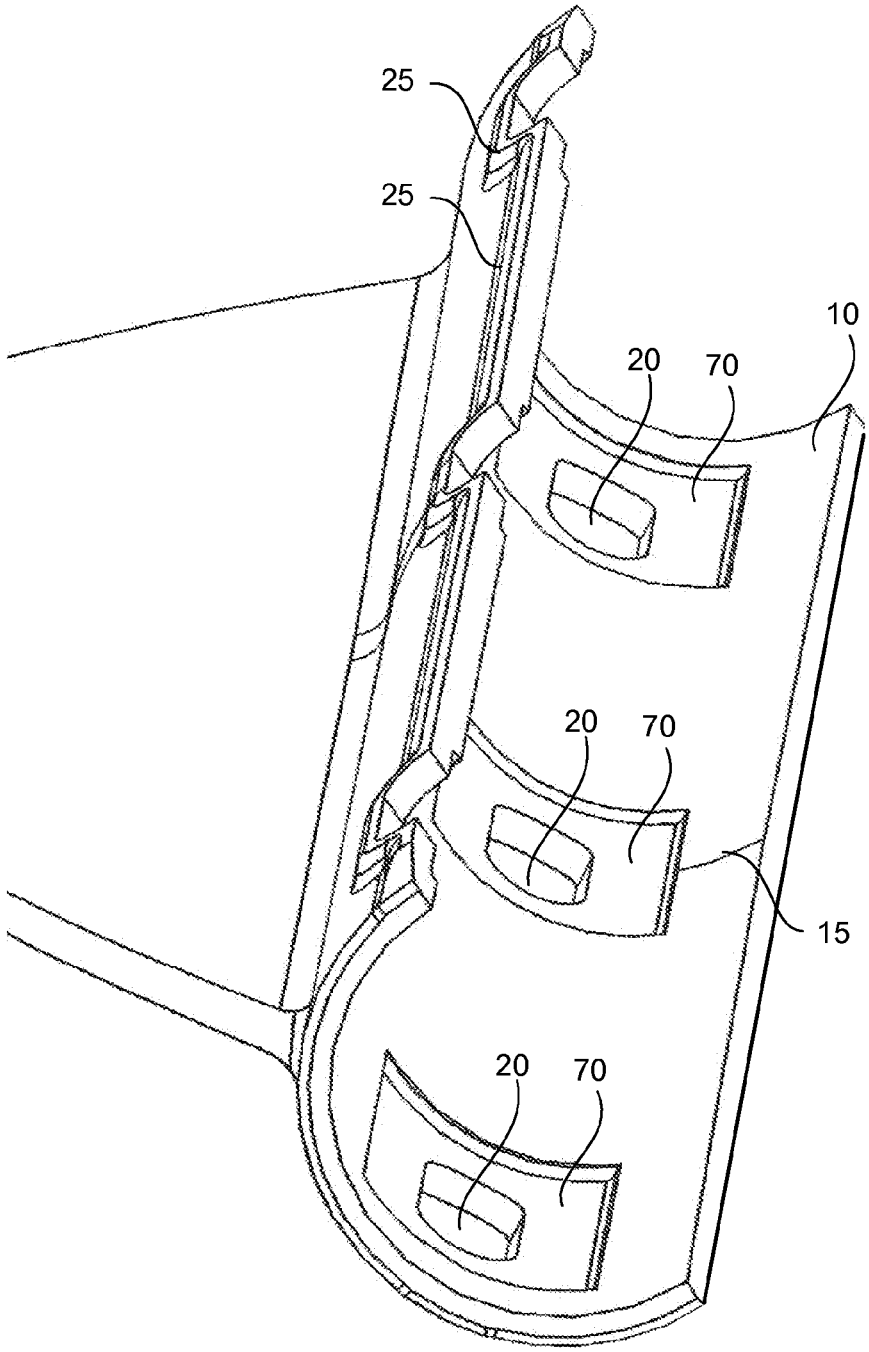
FIG. 4 depicts a perspective view of a cross section taken lengthwise through a fletching sleeve in accordance with an embodiment of the present disclosure.

FIG. 4 depicts a perspective view of a cross section taken lengthwise through a fletching sleeve in accordance with an embodiment of the present disclosure. The depiction shows the fletching sleeve 10, the core pin abutment line 15, the glue holes 20, raised portions 25 and raised portion cavities 70 adjacent the glue holes 20 formed on the inside of the fletching sleeve. The cavities draw glue from the holes much the same way that the channels draw glue from the holes. The cavities are therefore also formed at a depth and width of 5 to 10 one thousandths of an inch. The cavities may be formed in embodiments of the disclosure in place of or in addition to the channels in order to increase the bonding surface area between the fletching sleeve 10 and the arrow shaft. The cavities shown are depicted as square or rectangular but embodiments of the disclosure include circular, oblong and any other geometrical or random shape.

In embodiments of the present disclosure, cavities 70 may be configured to form a stretch area between a sleeve area above each cavity and another area of the sleeve, the stretch areas configured to lower an overall stretch resistance of the sleeve 10 to facilitate an application of the sleeve 10 onto the arrow shaft. A plurality of glue holes 20 may be defined in the sleeve wherein a cavity 70 is formed one of adjacent a glue hole and formed concentric with a glue hole. an outside surface of the fletching sleeve 10 adjacent the holes 20 may be slightly raised as depicted by 25. A thickness of the sleeve may also be constant and a portion of the sleeve may be thinner over the cavities in relation to the rest of the sleeve. Therefore the cavities may form a stretch area between the resulting thinner sleeve adjacent a glue hole and the thicker portions of the sleeve.

Figure 5:
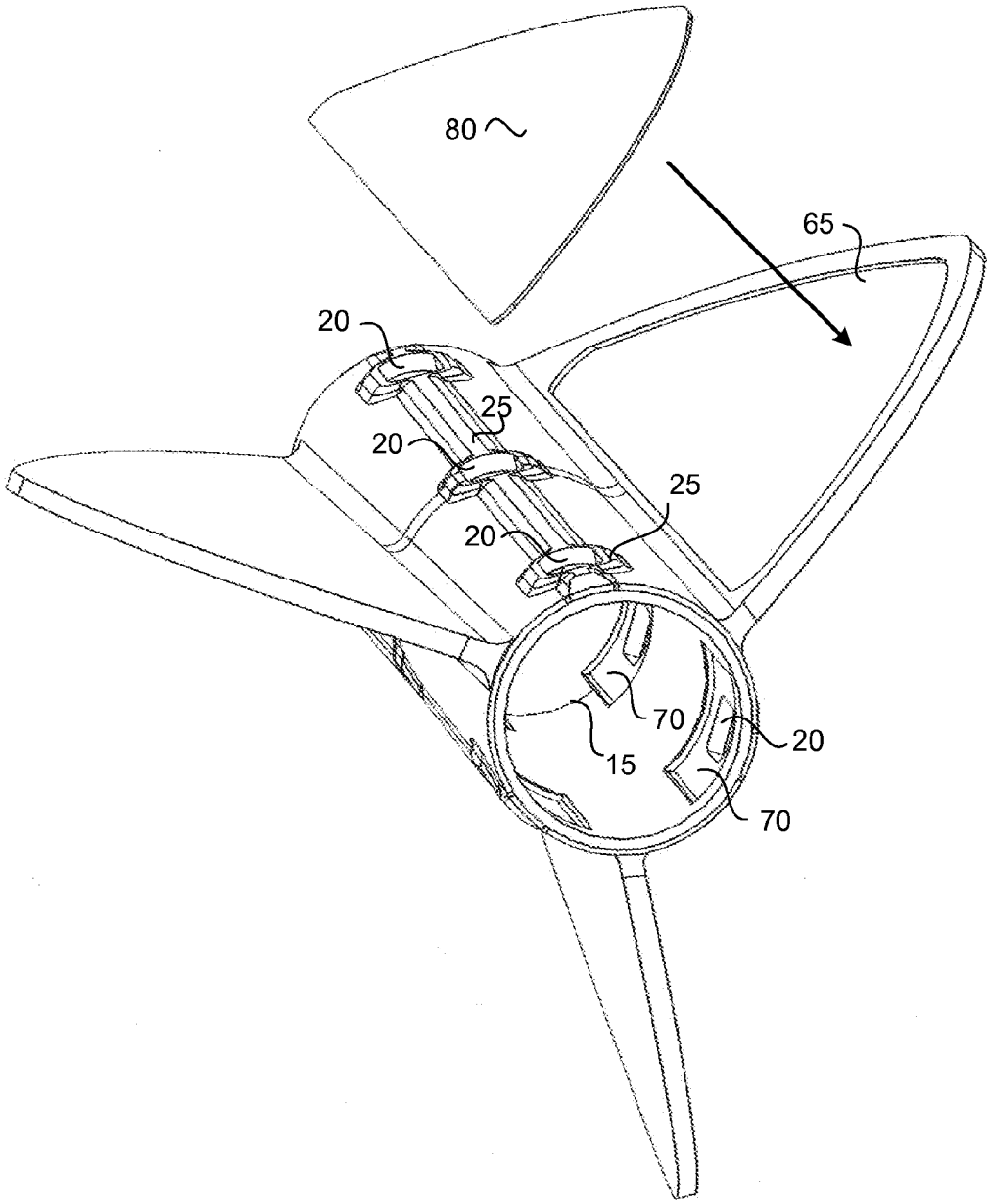
FIG. 5 depicts a perspective view of a geometric cavity fletching sleeve including a recessed vane in accordance with an embodiment of the present disclosure.

FIG. 5 depicts a perspective view of a geometric cavity fletching sleeve including a recessed vane in accordance with an embodiment of the present disclosure. The depiction includes the fletching sleeve 10, the core pin abutment line 15, glue holes 20, raised portions 25, a recessed vane 65, geometric cavities 70 and a sticker 80. The sticker 80 fits into the recess in the vane 65 to be flush with the non-recessed surface and avoid aerodynamic interference with the sticker 80. The sticker may be used to decorate the vane and display identifying or advertising indicia. Though only one vane is depicted with a recess, embodiments include recesses for all three or more vanes.

An archery fletching sleeve 10 as disclosed may comprise at least one adhesive application portal or glue hole 20 therein, wherein a ratio of portal area to sleeve outside surface area is at least one part portal area in 18.4 parts sleeve surface area, the portal(s) configured to receive an adhesive applied to the arrow shaft at the portal(s). Embodiments of the disclosure may include a ratio of an area of the adhesive applied to the arrow shaft at the portal(s) 20 to be at least one part in 18.4 parts sleeve surface area.

Figure 6:
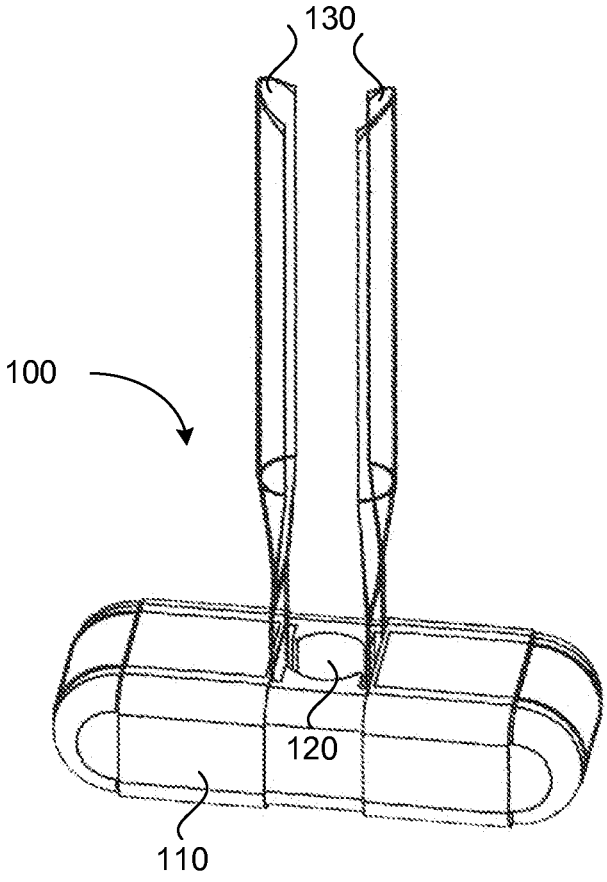
FIG. 6 depicts a perspective view of a collet sleeve applicator in accordance with an embodiment of the present disclosure.

FIG. 6 depicts a perspective view of a collet sleeve applicator in accordance with an embodiment of the present disclosure. The collet sleeve applicator includes a handle 110, a hole 120 formed in the handle and the two semi-cylindrical finger-like extensions 130 disposed axially to the hole 120. Tips of the finger extensions may be chamfered and otherwise configured to be easily received into an inside diameter of a fletching sleeve. The body of the collet-like applicator may be formed into a handle configured orthogonally to the two semi-cylindrical fingers designed to fit into the palm of a user's hand. The collet applicator may be formed from at least one of a polycarbonate material, a metallic material and any other substantially rigid material.

Figure 7:
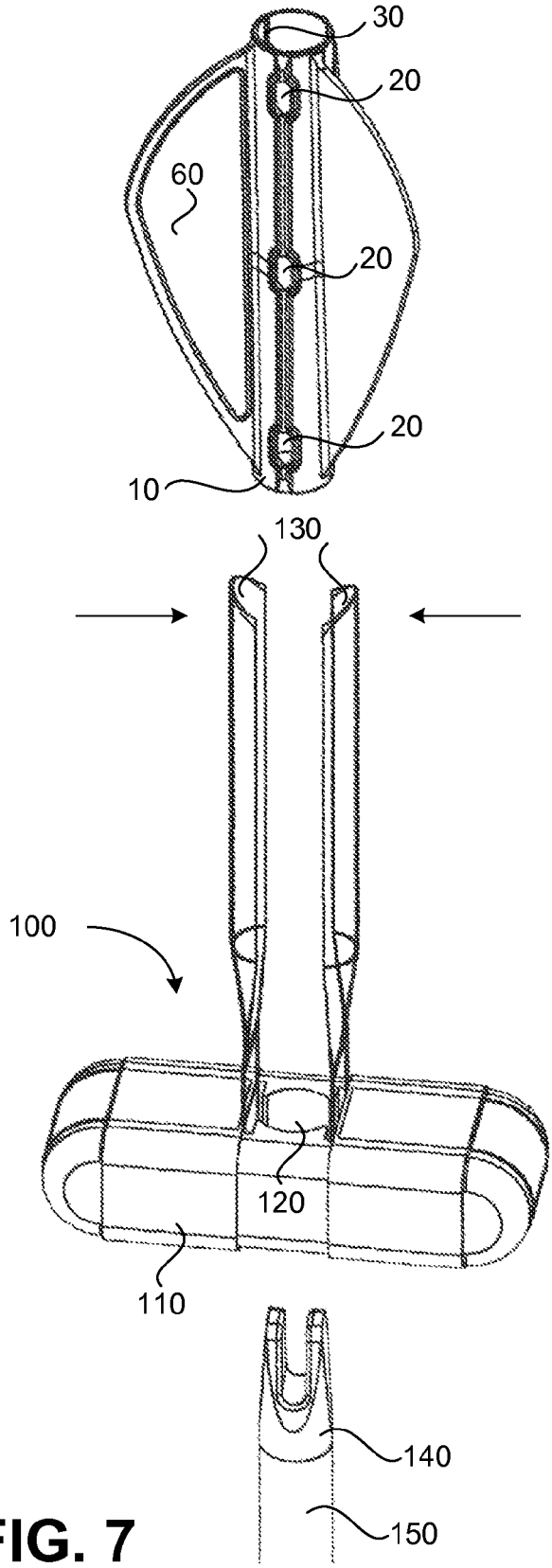
FIG. 7 depicts a perspective view of a fletching system in accordance with an embodiment of the present disclosure.

FIG. 7 depicts a perspective view of a fletching system in accordance with an embodiment of the present disclosure. The system includes the fletching sleeve 10 and the collet applicator 100. The arrow nock 140 and the arrow shaft 150 are typical of commercially available arrows. The finger extensions 130 of the collet applicator 100 are configured to deflect inwardly as indicated by the two opposing arrows to fit an inside diameter of a fletching sleeve 10. A length of the two finger extensions 130 may approximate the length of a fletching sleeve. A diameter of the collet applicator hole 120 may approximate most commercially available arrow nocks and shafts.

Figure 8:
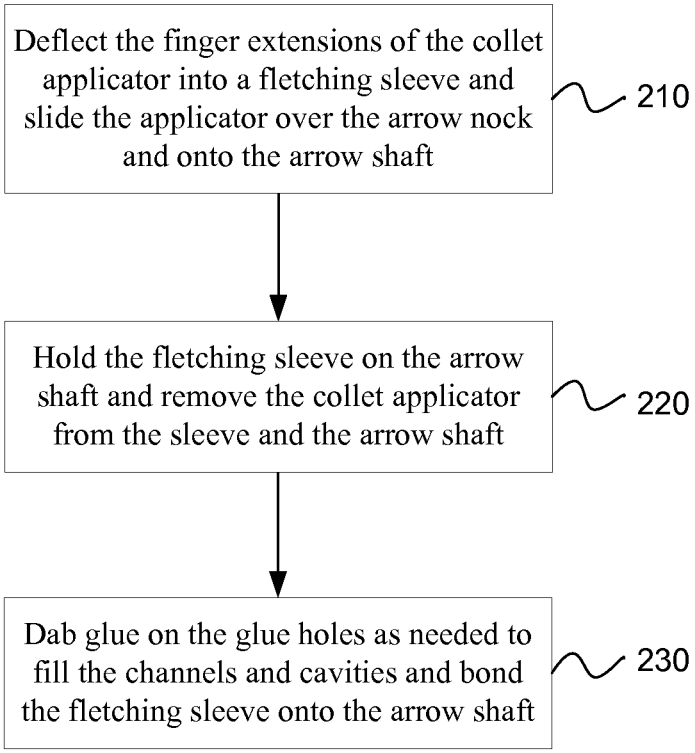
FIG. 8 depicts a flow chart of a method of application of the fletching sleeve using the fletching system in accordance with an embodiment of the present disclosure.

FIG. 8 depicts a flow chart of a method of application of the fletching sleeve using the fletching system in accordance with an embodiment of the present disclosure. The method includes 210 deflecting the collet applicator fingers 130 into a fletching sleeve and sliding the collet applicator over the arrow nock and onto the arrow shaft. The method also includes 220 holding the fletching sleeve on the arrow shaft and removing the collet applicator from the sleeve and the arrow shaft. The method additionally includes 230 dabbing glue on the glue holes as needed to fill the channels and cavities and bond the fletching sleeve onto the arrow shaft.

Embodiments of the fletching sleeve 10 may be manufactured using a co-extrusion process with two materials, or through a two shot injection mold process, or even an over mold injection mold process. Two core pins may be used to form the disclosed fletching sleeve in order to form an optimal inside sleeve diameter. Manufacturing via a single core pin may cause concentric issues with the sleeve diameter and may require support pins through the sleeve 10 to help stabilize the core pin. Therefore, a dual pin method of manufacturing enables forming a straighter sleeve 10 because the two core pins may meet approximately in the middle inside of the sleeve at the core pin abutment line 15 and may be separately set prior to and during injection. A two pin method of manufacturing as disclosed also facilitates draft, or the removing of the fletching sleeve 10 from the injection mold. This element of the disclosure is particularly helpful in rapid injection molding manufacturing.

An inside diameter of the fletching sleeve may be greater than an outside diameter of the arrow shaft to which it is affixed and therefore facilitate sliding the sleeve onto the shaft. Embodiments having an inside diameter of the arrow sleeve smaller than an outside diameter of the arrow shaft may also be included in embodiments of the disclosure allowing for frictional fit of the sleeve via stretch sutures onto the arrow shaft as disclosed herein. The actual difference in diameters may be very small in order to allow for manufacturing tolerances approximating an equivalence thereof.

A method of producing or manufacturing an archery vane is also embodied herein using a two shot, over mold, or co-extrusion to produce a different color cock vane. Where there are three vanes on an arrow, two of them may be one color and the third (cock vane) a different color to aid in clocking the arrow properly on the bowstring. Also, an embodied process may injection mold a number of colors at one time causing a mixing camouflage type pattern. A hydrographic process also allows dipping different patterns onto thermo plastic elastomers and thermo plastic urethanes.

An embodiment of the disclosure may include a center sleeve with features that make it more flexible to allow expansion over a wide range of shaft diameters and allow harder and tougher vane material for durability. An embodiment also may include a small diameter carbon shaft that is glued into the back of an arrow so that a one piece vane can be installed with a flush fit with the main diameter of the arrow shaft. Also, a cone style installation tool may be included in an embodiment that may replace the nock in the end of an arrow temporally while the vane is installed.

Embodied methods of application may also include an air hose adaptor for installing fletching onto shaft. A custom air hose adaptor may allow easy installation of a smaller diameter one piece fletching over a larger arrow shaft. Another embodied method may include attaching a one piece fletching to arrow shafts comprising double sided tape, and solvent. Other embodiments may comprise spraying an arrow shaft with aerosol hairspray which acts as a lubricant for a short period of time, while the fletching is installed over the shaft. Thereafter the hairspray dries and bonds the fletching to the arrow. Talcum powder may also be applied to the arrow and the vane to aid in application or installation. Yet another method of application may include inserting a needle glue applicator under the sleeve while the sleeve is on the arrow shaft.

An embodiment of the present disclosure may include laying down a spherical or cylindrical bead of glue around the shaft and sliding the fletching sleeve onto or adjacent the bead of glue. A first bead of glue may also be applied adjacent a first end of the sleeve and a second bead of glue may also be applied adjacent a second end of the sleeve on the arrow shaft. The glue portals 34 formed at the end of a fletching sleeve by a slot or channel therein are configured to draw glue from the bead of glue at either end of the fletching sleeve into and through the slots and channels formed with the arrow shaft. The embodiment thusly described may not therefore require additional glue holes between ends of the fletching sleeve in order to secure the fletching sleeve to the arrow shaft. The glue or adhesive may also be applied responsive to the sleeve being positioned in a predetermined location on the arrow shaft and secure the fletching sleeve onto the arrow shaft for certain applications inspite of glue in the channels thereof.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents to be included by reference in a non-provisional utility application.

What is claimed is:

1. An archery fletching sleeve configured to fit around an arrow shaft, the sleeve comprising a plurality of cavities and contact portions on an inner surface of the sleeve, the cavities configured to form at least one channel together with the arrow shaft for an application of an adhesive there between and the contact portions configured to directly contact the arrow shaft, the channel(s) configured to interconnect a plurality of glue holes or portals defined in the sleeve and draw a glue applied to the holes or portals through the channel(s) via a capillary action in the formed channel(s).

2. The fletching sleeve of claim 1, wherein a ratio of a channel height to a vane height is 1 part channel height to 60 parts vane height plus or minus a manufacturing tolerance of 10%.

3. The fletching sleeve of claim 1, wherein a portion of the sleeve over the cavities forms a raised rib portion on an outside surface of the sleeve in order to maintain a constant thickness of the sleeve over the cavities.

4. The fletching sleeve of claim 1, wherein the cavities form one of a slot, a square, a rectangular and an oblong shape.

5. The fletching sleeve of claim 1, wherein the cavities are configured to form a stretch area between a sleeve area above each cavity and another area of the sleeve, the stretch areas configured to lower an overall stretch resistance of the sleeve to facilitate an application of the sleeve onto the arrow shaft.

6. The fletching sleeve of claim 1, further comprising a plurality of glue holes defined in the sleeve wherein a cavity is formed one of adjacent a glue hole and formed concentric with a glue hole.

7. The fletching sleeve of claim 1, further comprising at least 3 vanes longitudinally attached to the sleeve, one of the vanes comprising a recess configured to receive one of a sticker and a graphic plate.

8. The fletching sleeve of claim 1, wherein the cavities form a plurality of slots on an inner surface of the sleeve, the slots configured to interconnect a plurality of glue holes defined in the sleeve, the slots configured to form channels with the arrow shaft and draw a glue applied to the holes through the slots via a capillary action in the formed channels.

9. The fletching sleeve of claim 1, further comprising the cavities configured to form a plurality of slots on an inner surface of the sleeve, the slots configured to be parallel with an elongate axis of the sleeve, the slots configured to form a plurality of stretch sutures between a sleeve portion above each slot and another portion of the sleeve, the stretch sutures configured to lower an overall stretch resistance of the sleeve to facilitate an application of the sleeve onto the arrow shaft.

10. The fletching sleeve of claim 1, further comprising the cavities configured to form a plurality of circumferential slots on the inner surface of the sleeve, the circumferential slots concentric with a center defined in the sleeve.

11. The fletching sleeve of claim 1, further comprising the cavities configured to form a plurality of slots on an inner surface of the sleeve wherein the slots comprise a depth of (5 thousandths of an inch) 0.13 mm to (10 thousandths of an inch) 0.25 mm and a width of (one thousandths of an inch) 0.03 mm thus configured to form a capillary column able to draw a cyanoacrylate glue across a length of (1.75 inches) 44.5 mm against the force of gravity.

12. The fletching sleeve of claim 1, further comprising the cavities configured to form a plurality of slots on an inner surface of the sleeve wherein a length of a slot extends from a first end of the sleeve to a second end of the sleeve and the length is nominally (1.75 inches) 44.5 mm including one of a ten percent plus and a ten percent minus manufacturing tolerance.

13. The fletching sleeve of claim 1, further comprising the cavities configured to form a plurality of slots on an inner surface of the sleeve wherein the slots comprise one configuration of substantially orthogonal internal vertices and another semi-circular configuration with no vertices and any other slot-like configuration.

14. An archery fletching sleeve configured to fit around a commercially available arrow shaft, the sleeve defining at least one adhesive application portal formed together with the arrow shaft to receive an adhesive during an application thereof onto the arrow shaft wherein an adhesive application portal comprises any length, radius and shape in the sleeve and be joined by a plurality of glue slots of any length formed on an inside of the fletching sleeve running longitudinally, radially and any direction from one of a portal to another portal and to a slot dead-end.

15. The fletching sleeve of claim 14, wherein the adhesive application portal(s) comprise(s) raised portions configured to protrude above an outside diameter of the sleeve and receive and contain the adhesive for application onto the arrow shaft.

16. The fletching sleeve of claim 14, further comprising a plurality of longitudinal vanes, wherein the vanes are one of attached to the sleeve and formed as an integral part of the sleeve, the vanes further configured to be one of offset from an elongate axis of the sleeve and formed in-line with the elongate axis of the sleeve, the offset axis configured to impart an aerodynamic spin to the arrow in flight.

17. The fletching sleeve of claim 14, a ratio of a slot height to a sleeve thickness/height is 1 part slot height to 3 parts sleeve thickness/height plus or minus a manufacturing tolerance of 10%.

18. The fletching sleeve of claim 14, wherein an adhesive application portal formed at an end of the fletching sleeve by a slot term therein is configured to draw glue from a bead of glue disposed around the end of the fletching sleeve into and through the channels formed with the slots and the arrow shaft.

19. An archery fletching sleeve configured to fit around a commercially available arrow shaft, the sleeve comprising at least one adhesive application portal therein, wherein a ratio of portal area to sleeve surface area is at least one part portal area in 18.4 parts sleeve surface area, the portal(s) configured to receive an adhesive applied to the arrow shaft at the portal (s).

20. The fletching sleeve of claim 19, further comprising a ratio of an area of the adhesive applied to the arrow shaft at the portal(s) to be at least one part in 18.4 parts sleeve surface area.

* * * * *